US007784212B1

(12) United States Patent
Chilton

(10) Patent No.: US 7,784,212 B1
(45) Date of Patent: Aug. 31, 2010

(54) GUN SHOOTING REST DEVICE

(76) Inventor: Wade Johnson Chilton, 195 Nursery Ln, Ararat, NC (US) 27007

( * ) Notice: Subject to any disclaimer, the term of this patent is extended or adjusted under 35 U.S.C. 154(b) by 1096 days.

(21) Appl. No.: 11/443,332

(22) Filed: May 30, 2006

Related U.S. Application Data

(63) Continuation-in-part of application No. 11/043,865, filed on Jan. 26, 2005, now abandoned.

(51) Int. Cl.
*F41C 27/00* (2006.01)

(52) U.S. Cl. ..... 42/94

(58) Field of Classification Search ..... 42/94
See application file for complete search history.

(56) References Cited

U.S. PATENT DOCUMENTS

| | | | | | |
|---|---|---|---|---|---|
| 167,169 | A | * | 8/1875 | Hare | 42/94 |
| 3,156,062 | A | | 11/1964 | Stevenson | |
| D203,680 | S | | 2/1966 | Alision | |
| 3,390,477 | A | | 7/1968 | Galbraith | |
| 3,576,084 | A | | 4/1971 | Anerson, Jr. | |
| 4,265,045 | A | * | 5/1981 | Garbini | 42/94 |
| 4,854,066 | A | | 8/1989 | Canterbury, Sr. | |
| 5,018,294 | A | | 5/1991 | McGuffee | |
| 5,194,678 | A | * | 3/1993 | Kramer | 42/94 |
| 5,345,706 | A | * | 9/1994 | Brown | 42/94 |
| 5,528,846 | A | | 6/1996 | Baggett | |
| 5,903,995 | A | * | 5/1999 | Brubach | 42/94 |
| 5,974,719 | A | | 11/1999 | Simonek | |
| 6,042,080 | A | * | 3/2000 | Shepherd et al. | 248/683 |
| 6,267,335 | B1 | | 7/2001 | Barrett | |
| 6,584,719 | B1 | | 7/2003 | Morford | |
| 2004/0020097 | A1 | | 2/2004 | Deros | |

* cited by examiner

*Primary Examiner*—Troy Chambers

(57) ABSTRACT

A gun shooting rest device for added stability of the firearm during sighting and discharge of the firearm. The gun shooting rest device includes a base assembly for selectively engaging a support. A stanchion member is coupled to the base assembly whereby the stanchion member extends away from the base assembly. A support assembly is coupled to the stanchion member whereby the support assembly is positioned a distance from the base assembly. The support assembly is for selectively supporting the firearm to facilitate sighting of the firearm and steadying the firearm during discharge of the firearm.

21 Claims, 11 Drawing Sheets

GUN SHOOTING REST DEVICE

REFERENCE TO RELATED APPLICATION

This patent application is a continuation-in-part of my U.S. patent application Ser. No. 11/043,865, filed Jan. 26, 2005 now abandoned.

BACKGROUND OF THE INVENTION

1. Field of the Invention

The present invention relates to gun rests and more particularly pertains to a new gun shooting rest device for added stability of the firearm during sighting and discharge of the firearm.

2. Description of the Prior Art

The U.S. Pat. No. 4,854,066 reference provides for a pair of rifle support yokes that have no means for maintaining the rifle in the yokes when the rifle is discharged. Additionally, U.S. Pat. Nos. 3,159,062, 3,576,084 and 5,974,719 also teach the use of yokes to support a firearm and do not provide a means for retaining the firearm in the yokes when the firearm is discharged.

U.S. Pat. No. 5,018,294 provides a pair of straps that are to be secured around the forearm of the user and has a portion that extends to leg of the user to allow the user attempt to stabilize the firearm which leaves the firearm free to move independently of the of the support means and is using the body of the user to attempt stabilize the firearm. U.S. Pat. Nos. 3,390,477, 5,528,846 and 6,267,335 additionally teach the use of a device that extends between two portions of the body of the user in an attempt to stabilize the firearm.

U.S. Pat. No. 6,584,719 provides a rigid clamp arm that extends over an insert to retain a firearm in the insert when the firearm is being discharged which the use of the rigid clamp may allow the firearm to move between the clamp arm and the insert when the firearm is discharged should the clamp arm and insert not fit the firearm in a tight fashion. U.S. Pat. No. Des. 203,680 and Application 2004/0020097 both provide for a gun rest with a plurality of yokes that are open and have no means to inhibit a firearm positioned in the yokes from rising when the firearm is discharged.

In these respects, the gun shooting rest device according to the present invention substantially departs from the conventional concepts and designs of the prior art, and in so doing provides an apparatus primarily developed for the purpose of added stability of the firearm during sighting and discharge of the firearm.

SUMMARY OF THE INVENTION

In view of the foregoing disadvantages inherent in the known types of gun rests now present in the prior art, the present invention provides a new gun shooting rest device construction wherein the same can be utilized for added stability of the firearm during sighting and discharge of the firearm.

To attain this, the present invention generally comprises a base assembly for selectively engaging a support. A stanchion member is coupled to the base assembly whereby the stanchion member extends away from the base assembly. A support assembly is coupled to the stanchion member whereby the support assembly is positioned a distance from the base assembly. The support assembly is for selectively supporting the firearm to facilitate sighting of the firearm and steadying the firearm during discharge of the firearm.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

One significant advantage of the present invention is the use of a retaining member extending over the top of the firearm and that comprised of an elastic material to conform to the firearm to secure the firearm in the cradle member when the firearm is be discharged.

Further advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects of the invention will become apparent when consideration is given to the following detailed description thereof. Such description makes reference to the annexed drawings wherein.

DESCRIPTION OF PREFERRED EMBODIMENTS

Figure 1:
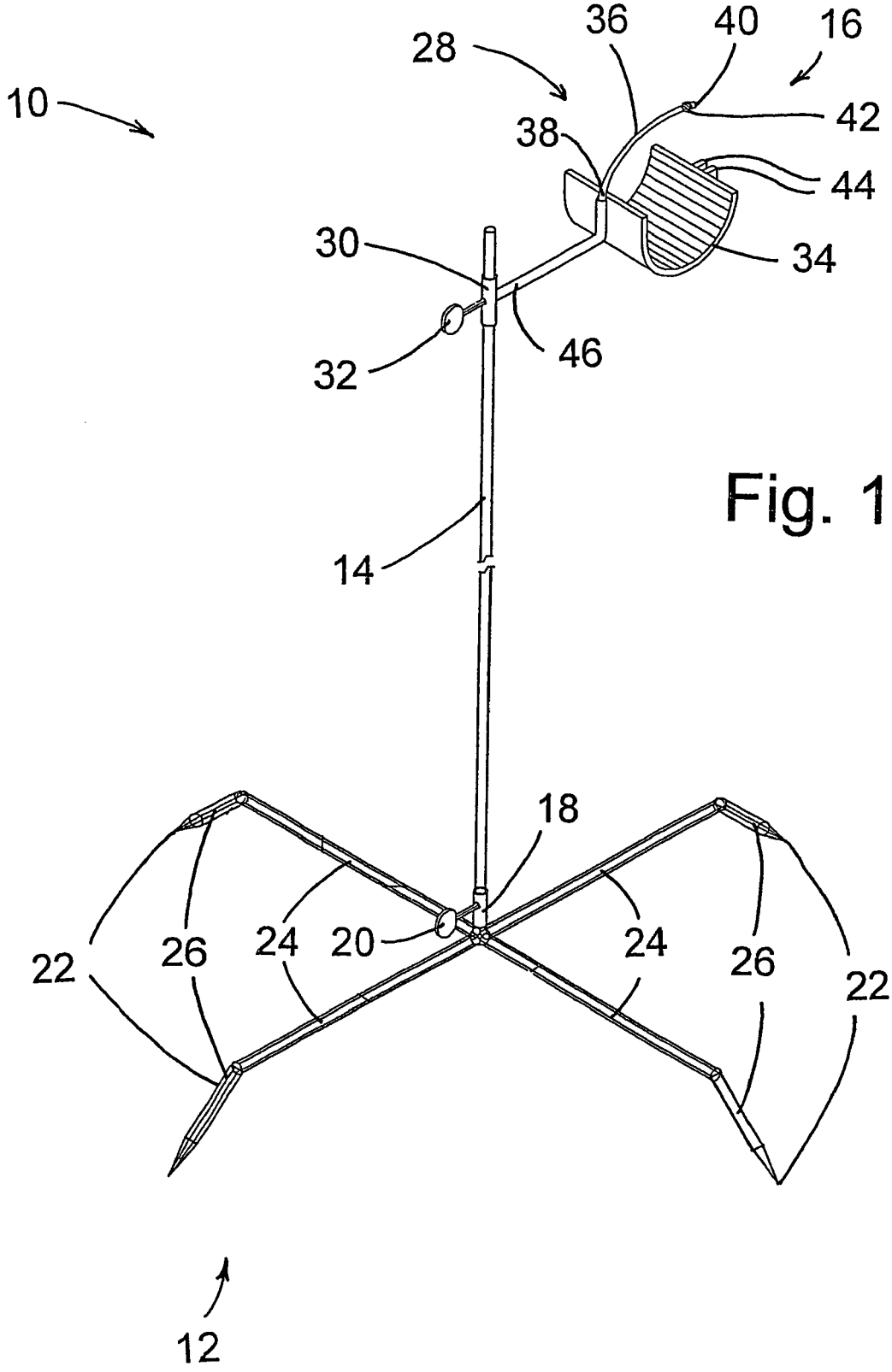
FIG. 1 is a perspective view of a new gun shooting rest device according to the present invention.

With reference now to the drawings, and in particular to FIGS. 1 through 12 thereof, a new gun shooting rest device embodying the principles and concepts of the present invention and generally designated by the reference numeral 10 will be described.

As best illustrated in FIGS. 1 through 12, the gun shooting rest device 10 generally comprises a base assembly 12 for selectively engaging a support.

A stanchion member 14 is coupled to the base assembly 12 whereby the stanchion member 14 extends away from the base assembly 12.

A support assembly 16 is coupled to the stanchion member 14 whereby the support assembly 16 is positioned a distance from the base assembly 12. The support assembly 16 is for selectively supporting the firearm to facilitate sighting of the firearm and steadying the firearm during discharge of the firearm.

The base assembly 12 comprises a receiver member 18 for selectively receiving the stanchion member 14. The stanchion member 14 is selectively removable from the receiver member 18 to permit more compact storage of the base assembly 12 and the stanchion member 14 when not in use.

The base assembly 12 comprises a securing member 20 being operationally coupled to the receiver member 18. The securing member 20 selectively extends through the receiver member 18 whereby the securing member 20 selectively engages the stanchion member 14 to inhibit inadvertent removal of the stanchion member 14 from the receiver member 18. The securing member 20 may comprise a thumb screw to threadably engage the receiver member 18 and press against the stanchion member 14 in the receiver member 18 to inhibit inadvertent removal of the stanchion member 14 from the receiver member 18.

The base assembly 12 comprises a plurality of leg members 22 coupled to the receiver member 18. Each of the leg members 22 extend outwardly from the receiver member 18. The leg members 22 are for engaging the support to inhibit sliding of the base assembly 12 along the support when the firearm is being steadied and discharged.

Each of the leg member 22*s* comprises a base portion 24 and an end portion 26. The base portion 24 is coupled to the receiver member 18 whereby the end portion 26 is positioned opposite the receiver member 18. The end portion 26 of each of the leg member 22*s* is for engaging the support to inhibit sliding of the base assembly 12 with respect to the support.

The end portion 26 of each of the leg member 22*s* extends at an angle to the base portion 24 of the associated one of the leg member 22*s* to facilitate the end portion 26 of each of the leg portions insertion into the support when the support is a soft surface. The end portion 26 of each of the leg member 22*s* tapers to a point opposite the base portion 24 of the associate one of the leg member 22*s* to facilitate insertion of the end portion 26 of each of the leg member 22*s* into the support when the support comprises soil.

The support assembly 16 comprises at least one cradle assembly 28 being selectively coupled to the stanchion member 14. The cradle assembly 28 selectively receives a portion of the firearm whereby the cradle assembly 28 supports the firearm.

The cradle assembly 28 comprises a sleeve member 30 slidably receiving the stanchion member 14. The sleeve member 30 permits the cradle assembly 28 to be positioned along a portion of a length of the stanchion member 14 to adjust a distance between the cradle assembly 28 and the base assembly 12.

The cradle assembly 28 comprises a locking member 32 being operationally coupled to the sleeve member 30. The locking member 32 selectively extends through the sleeve member 30 whereby the locking member 32 selectively engages the stanchion member 14 to inhibit inadvertent sliding of the sleeve member 30 along the stanchion member 14. The locking member 32 may comprise a thumb screw or a knob fastener to threadably engage the sleeve member 30 and press against the stanchion member 14 in the sleeve member 30 to inhibit inadvertent sliding of the sleeve member 30 along the stanchion member 14.

The cradle assembly 28 comprises a cradle member 34 being coupled to the sleeve member 30. The cradle member 34 is for selectively receiving a portion of the firearm to support the firearm when the firearm is being sighted and discharged. The cradle member 34 is substantially U-shaped with the firearm being placed into the cradle member 34 through an open upper end of the cradle member 34. The cradle member 34 may also be lined with a padding to inhibit the cradle member 34 from damaging the firearm.

The cradle assembly 28 comprises a retaining member 36 for inhibiting inadvertent exiting of the fire arm from the open upper end of the cradle member 34 when the firearm is discharged. The retaining member 36 comprises a first end 38 coupled to the cradle member 34. The retaining member 36 is selectively extended across the open upper end the cradle member 34 whereby a second end 40 of the retaining member 36 is selectively coupled to the cradle member 34 opposite the first end 38 to secure the retaining member 36 across the open upper end of the cradle member 34.

The retaining member 36 comprises a locking nub 42 coupled to the second end 40 of the retaining member 36. The retaining member 36 is selectively extended between a pair of tabs 44 extending from the cradle member 34 when the retaining member 36 is extended over the open upper end of the cradle member 34. The locking nub 42 engages the tabs 44 and inhibits the retaining member 36 inadvertently releasing from the tabs 44 and allowing the firearm to inadvertently exit the cradle member 34. The retaining member 36 may comprise an elastomeric material to allow the retaining member 36 to extend over and conform to a portion of the firearm that may extend above the cradle member 34.

The cradle assembly 28 comprises an extension arm 46 being coupled between the sleeve member 30 and the cradle member 34. The extension arm 46 positions the cradle member 34 a distance from the sleeve member 30 to allow the firearm to be positioned so that the user effectively grip and hold the firearm and not be hindered by the stanchion member 14.

Figure 2:
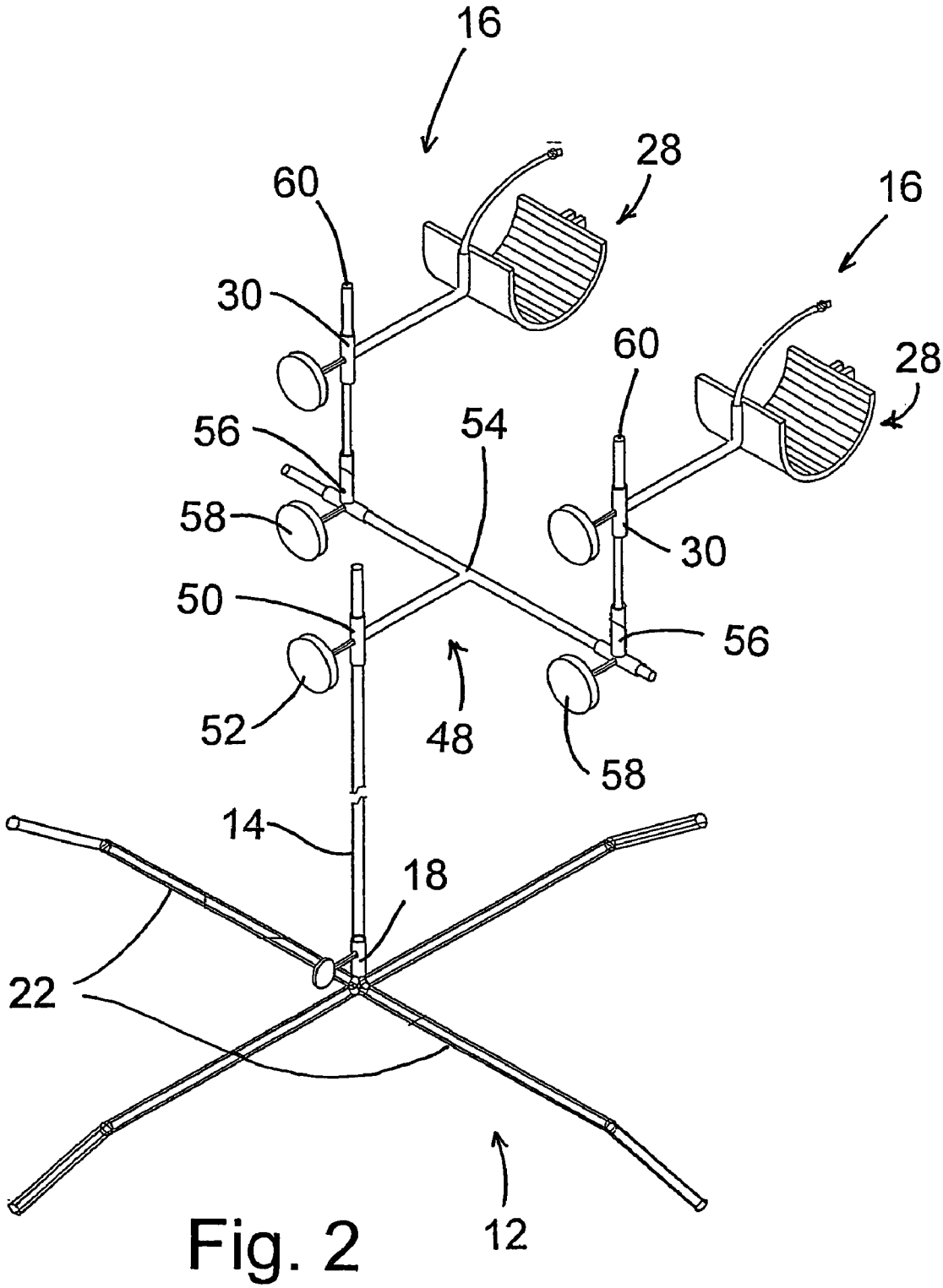
FIG. 2 is a perspective view of the present invention showing an embodiment of the support assembly.
Figure 3:
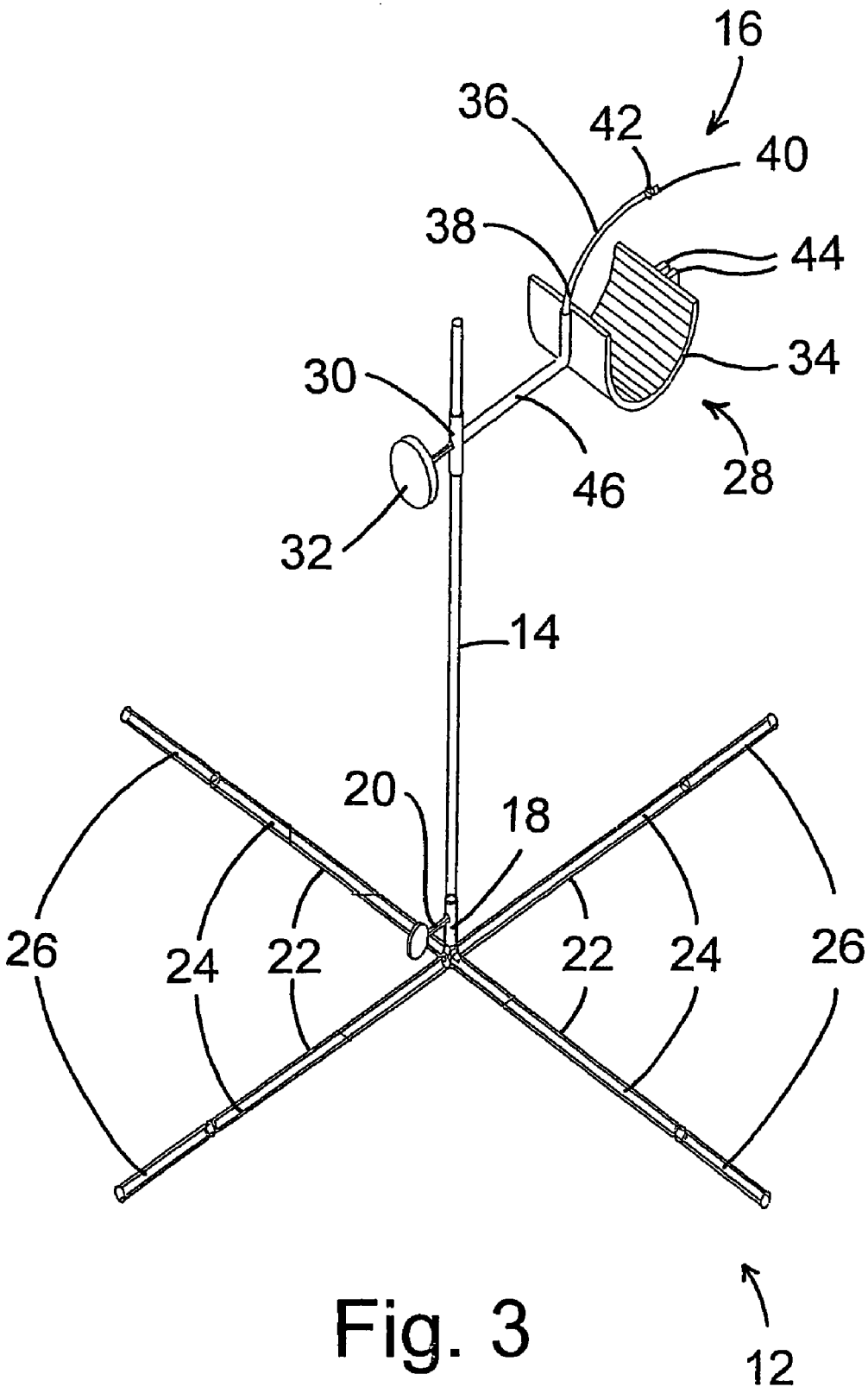
FIG. 3 is a perspective view of the present invention showing an embodiment of the base assembly.

In an embodiment, as shown in FIG. 2, the support assembly 16 comprises a bar assembly 48 being selectively coupled to the stanchion member 14 whereby the bar assembly 48 is selectively positioned along a length of the stanchion member 14. The bar assembly 48 is for selectively receiving a plurality of cradle assemblies 28 whereby the cradle assemblies 28 are aligned to allow each of the cradle assemblies 28 to support a portion of the firearm.

The bar assembly 48 comprises an adjustment member 50 slidably receiving the stanchion member 14. The adjustment member 50 permits the bar assembly 48 to be positioned along a portion of a length of the stanchion member 14 to adjust a distance between the bar assembly 48 and the base assembly 12.

The bar assembly 48 comprise an engaging member 52 being operationally coupled to the adjustment member 50. The engaging member 52 selectively extends through the adjustment member 50 whereby the engaging member 52 selectively engages the stanchion member 14 to inhibit inadvertent sliding of the adjustment member 50 along the stanchion member 14. The engaging member 52 may comprise a thumb screw or a knob fastener to threadably engage the adjustment member 50 and press against the stanchion member 14 in the adjustment member 50 to inhibit inadvertent sliding of the adjustment member 50 along the stanchion member 14.

The bar assembly 48 comprises a bifurcated arm member 54 coupled to the adjustment member 50. The bifurcated arm member 54 is substantially T-shaped. The bar assembly 48 comprises a pair of alignment members 56. Each of the alignment members 56 slidably receives one of the branches of the bifurcated arm member 54 to allow the distance between the cradle assemblies 28 to be adjusted. Each of the alignment members 56 comprises a tensioning member 58 that is threadably coupled to the associated one of the alignment members 56. The tensioning member 58 selectively engages the associated one of the branches of the bifurcated arm member 54 to retain the associated one of the alignment members 56 in the desired position.

The bar assembly 48 comprises a pair of vertical members 60. Each of the vertical members 60 is coupled to one of the alignment members 56 such that each of said vertical members 60 extends upwardly from the associated one of the alignment members 56. Each of vertical members 60 is slidably received by the sleeve member 30 of an associated one of the cradle assemblies 28 to allow the cradle assemblies 28 to be coupled to the bar assembly 48.

In an embodiment, as shown in FIG. 2, the end portion 26 of each of the leg member 22*s* is coated in a friction enhancing material. The friction enhancing material is for increasing friction between the end portion 26 of the leg member 22*s* and the support to inhibit sliding of the base assembly 12 across the support when the support is a hard surface.

Figure 4:
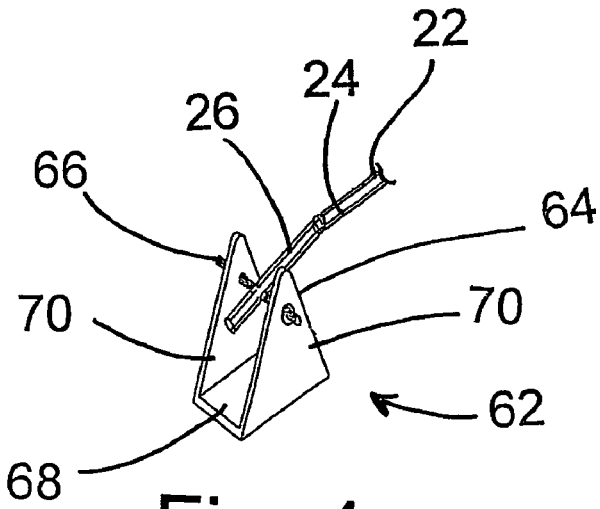
FIG. 4 is a perspective view of the present invention showing an embodiment of the base assembly.

In an embodiment, as shown in FIG. 4, the base assembly 12 comprises at least one foot assembly 62. The foot assembly 62 is pivotally coupled to one of the foot members whereby the foot assembly 62 is selectively pivoted to engage a surface of the support when the surface of the support is uneven. Optimally, a foot assembly 62 would be coupled to each of the foot member to allow the entire base assembly 12 to rest on the uneven surface.

The foot assembly 62 comprises a base member 64 and a pivot rod 66. The pivot rod 66 extends through the associated one of the foot members. The base member 64 is coupled to pivot rod 66 such that the base member 64 pivots with respect to the associated one of the foot members to allow the base member 64 of the foot assembly 62 to engage the uneven surface of the support.

The base member 64 of the foot assembly 62 comprises a bottom portion 68 and a pair of side portions 70 extending upwardly from the bottom portion 68. Each of the side portions 70 are oppositely coupled to the pivot rod 66 whereby the bottom portion 68 is positioned opposite the pivot rod 66. The bottom portion 68 of the base member 64 is for engaging the uneven surface. Additionally, a friction enhancing material may be coupled to a bottom of the bottom portion 68 to inhibit sliding of the base member 64 along the uneven surface.

Figure 5:
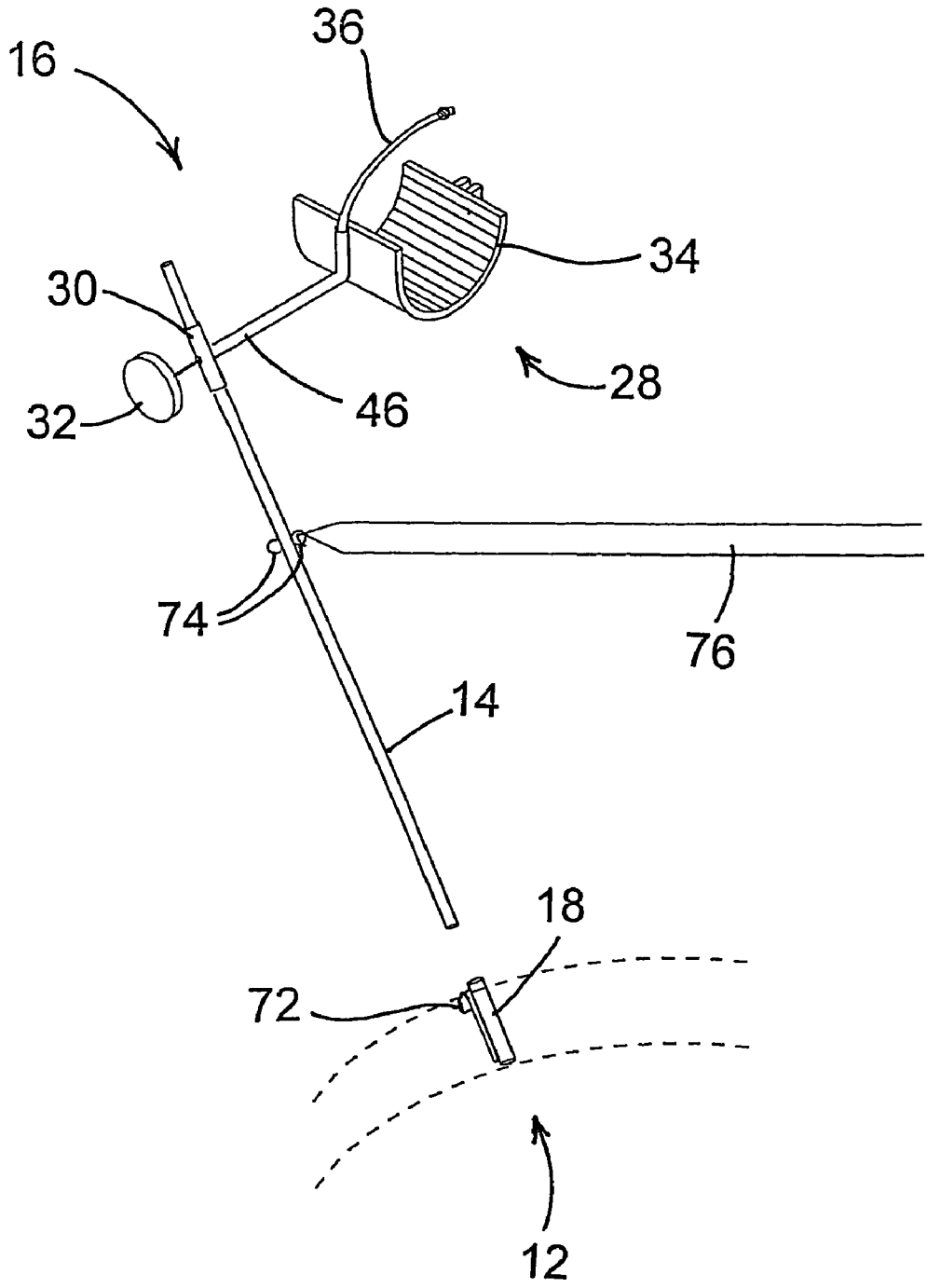
FIG. 5 is a perspective view of the present invention showing an embodiment of the base assembly in use on a belt of a user.
Figure 6:
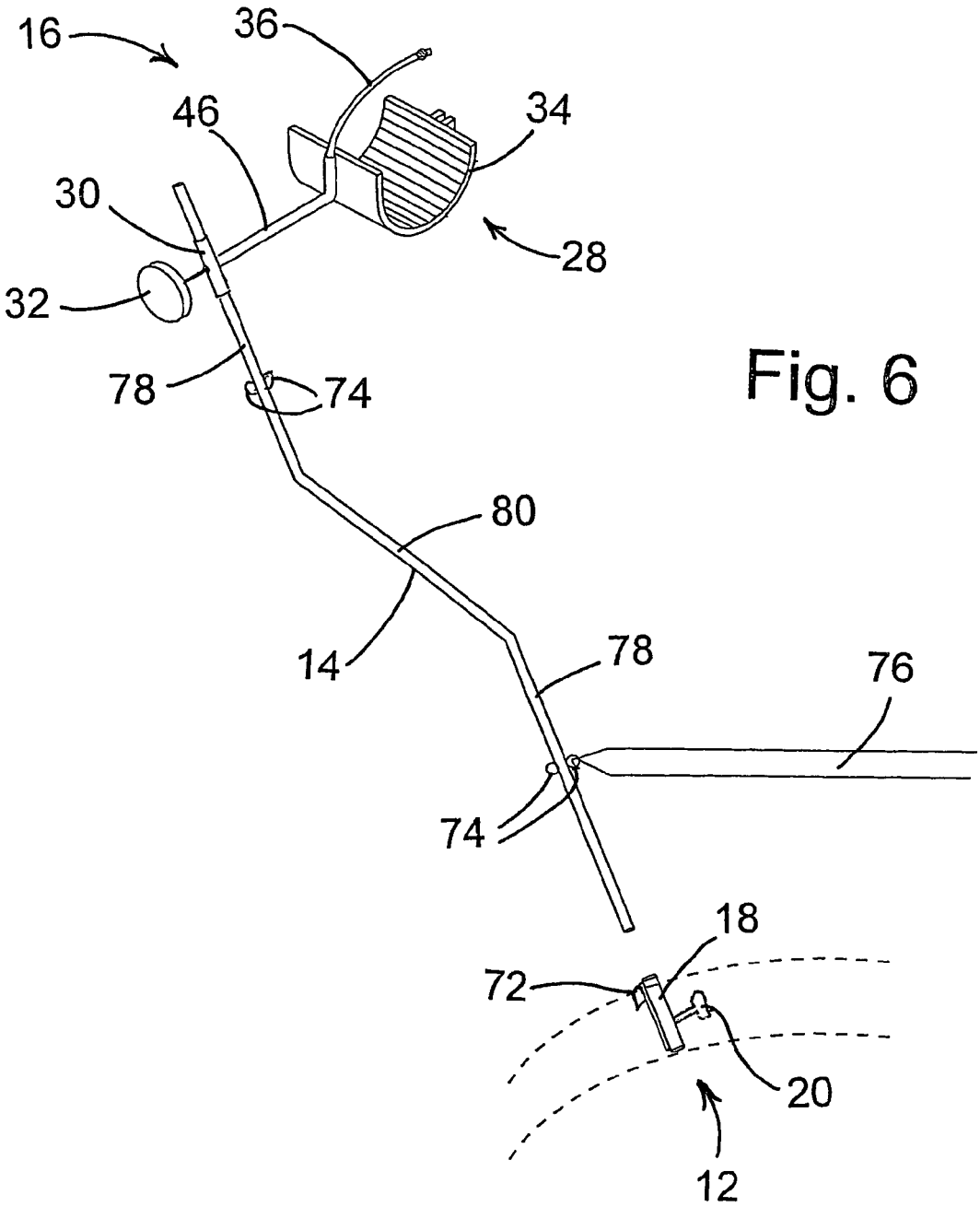
FIG. 6 is a perspective view of the present invention showing an embodiment of the stanchion member.

In an embodiment, as shown in FIGS. 5 and 6, the base assembly 12 comprises a clip portion 72. The clip portion 72 is coupled to the receiver member 18. The clip member is for engaging a belt of a user to permit the stanchion member 14 and the support assembly 16 to be supported from the belt of the user when the user is discharging the firearm while walking.

A plurality of ring members 74 may be coupled to the stanchion member 14 to allow a shoulder harness 76 to be selectively coupled to the stanchion member 14. The shoulder harness 76 provides additional stability to the stanchion member 14 when the user is walking.

The stanchion member 14 may also comprise a pair of distal portions 80 and a medial portion 82. The distal portions 80 are coupled to opposite ends of the medial portion 82. The medial portion 82 extends at an angle to the distal portions 80 to allow positioning of the cradle assembly 28 at distance from the body of the user. Additionally, the stanchion member 14 can be used with other embodiments of the base assembly 12 as shown in FIG. 7.

Figure 7:
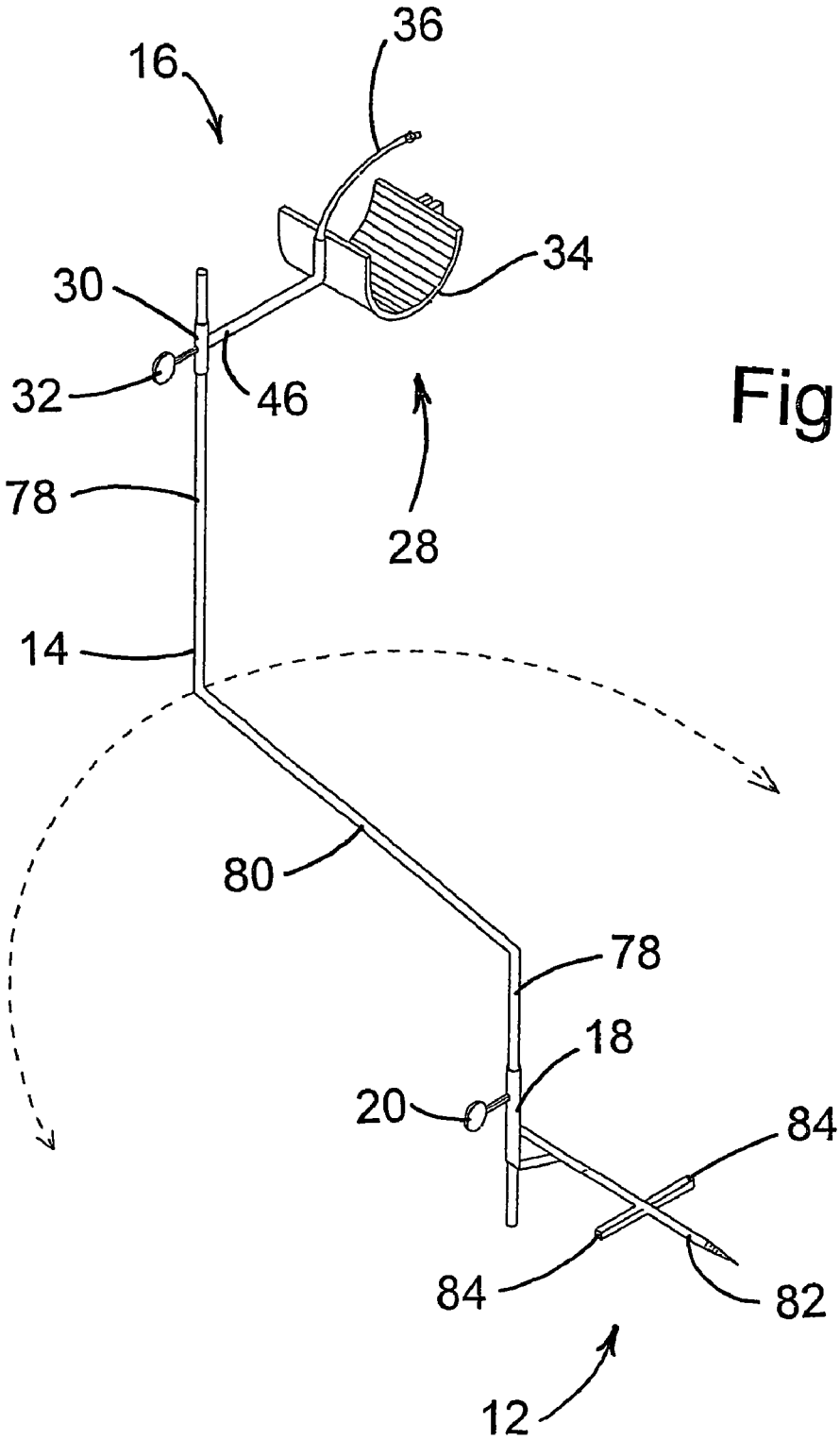
FIG. 7 is a perspective view of the present invention showing an embodiment of base assembly and the stanchion member.

In an embodiment, as shown in FIG. 7, the base assembly 12 comprises an auger arm 84 for being threadably inserted into the support to support the stanchion member 14 and the support assembly 16 from the support. The auger arm 84 is coupled to the receiver member 18.

The base assembly 12 comprises a plurality of handle members 86 being coupled to the auger arm 84 to facilitate gripping of the auger arm 84 when the auger arm 84 is threadably inserted into the support. The handle members 86 extending outwardly from the auger members whereby the handle members 86 are for being grasped by a user to facilitate gripping of the auger arm 84.

Figure 8:
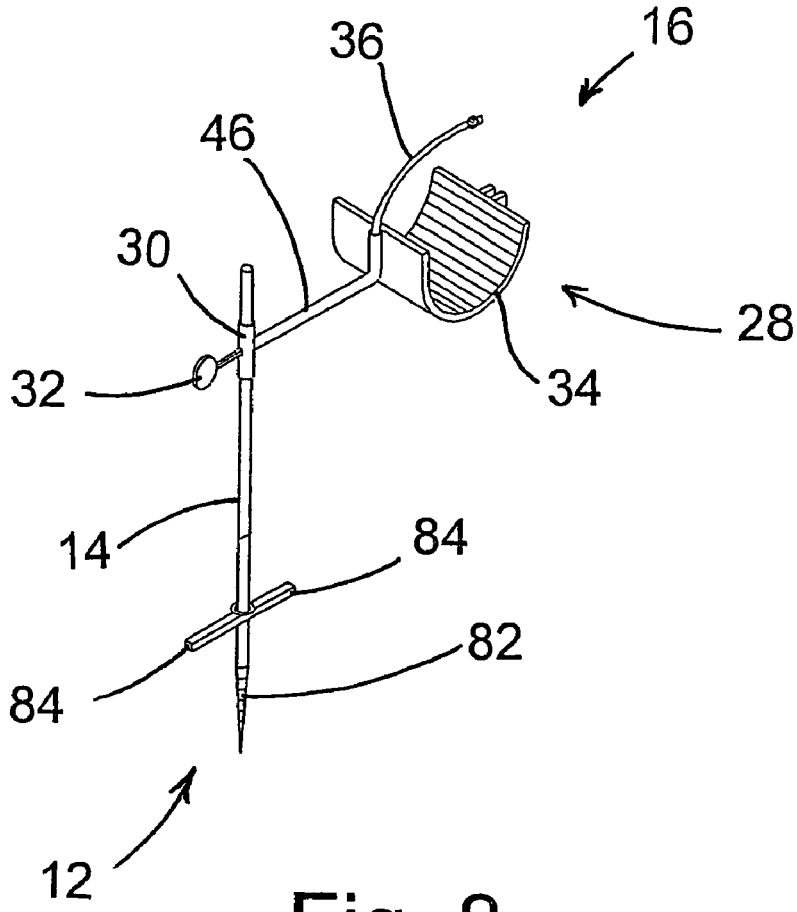
FIG. 8 is a perspective view of the present invention showing an embodiment of the base assembly shown in FIG. 7.

In an embodiment, as shown in FIG. 8, the base assembly 12 comprises an auger arm 84 for being threadably inserted into the support to support the stanchion member 14 and the support assembly 16 from the support. The auger arm 84 is coupled to the stanchion member 14.

The base assembly 12 comprises a plurality of handle members 86 being coupled to the auger arm 84 to facilitate gripping of the auger arm 84 when the auger arm 84 is threadably inserted into the support. The handle members 86 extending outwardly from the auger members whereby the handle members 86 are for being grasped by a user to facilitate gripping of the auger arm 84.

Figure 9:
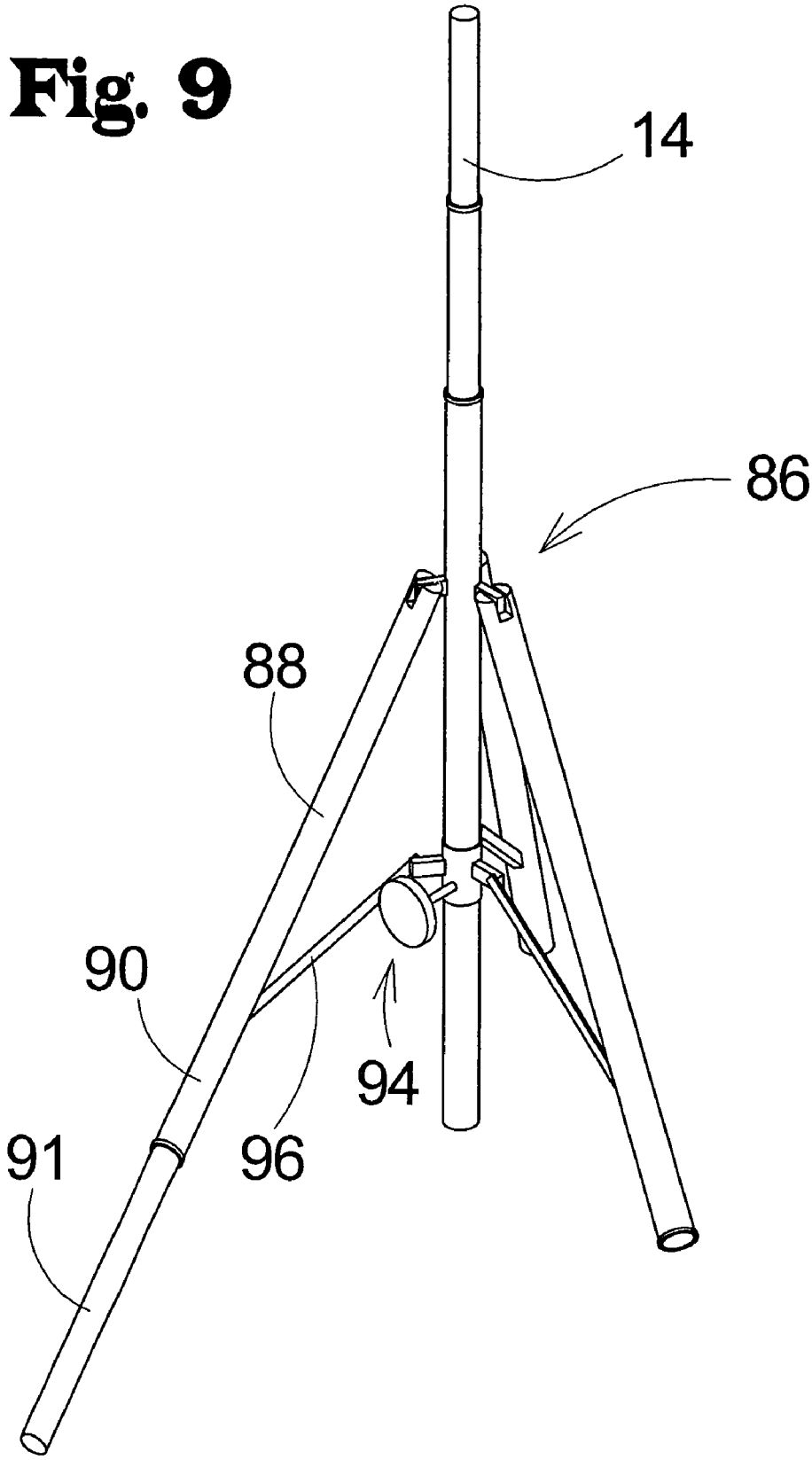
FIG. 9 is a perspective view of the present invention showing an optional multi-legged base assembly.

Optionally, as shown in FIG. 9, the base assembly may comprise a multi-legged assembly 86 that includes a plurality of leg members 88 that are radially extendable from the stanchion member 14. The drawings depict the multi-legged assembly 86 as having three legs members (e.g., a tripod), although it should be appreciated that any number of legs greater than two may be employed, and for example the multi-legged assembly 86 may comprise a quadpod with four leg members. Each leg member 88 of the plurality of leg members may be pivotable with respect to the stanchion member 14. As a further option, each leg member 88 may comprise at least two leg portions 90, 91 that are telescopically mounted together to permit adjustment of the length of the leg member. Each of the leg members 88 may be mounted on a tab that extends from the stanchion member 14. The multi-legged assembly 86 may further include a slide member 92 that is slidably mounted on the stanchion member 14, as well as a fixing element 94 mounted on the slide member 92 for selectively fixing a position of the slide member on the stanchion member. Illustratively, the fixing element 94 may comprise a knob that is mounted on a threaded shaft that passes through a threaded hole in the slide member 92 to contact an outer surface of the stanchion member 14, and apply pressure to secure the slide member against movement, and remove pressure to permit sliding movement of the slide member on the stanchion member. The multi-legged assembly 86 may further comprise a plurality of brace members 96. Each brace member 96 of the plurality of brace members may extend between the slide member 92 on the stanchion member 14 and one of the leg members 88. Each brace member 96 may be pivotable with respect to the stanchion member 14 and also with respect to the associated leg member 88. The leg members 88 may thus be selectively spread apart for use, and brought together for storage and transport of the device 10. As a further option illustrated in FIG. 9, the stanchion member may be comprised of multiple segments such that the stanchion may be telescopically extended and retracted.

Figure 10:
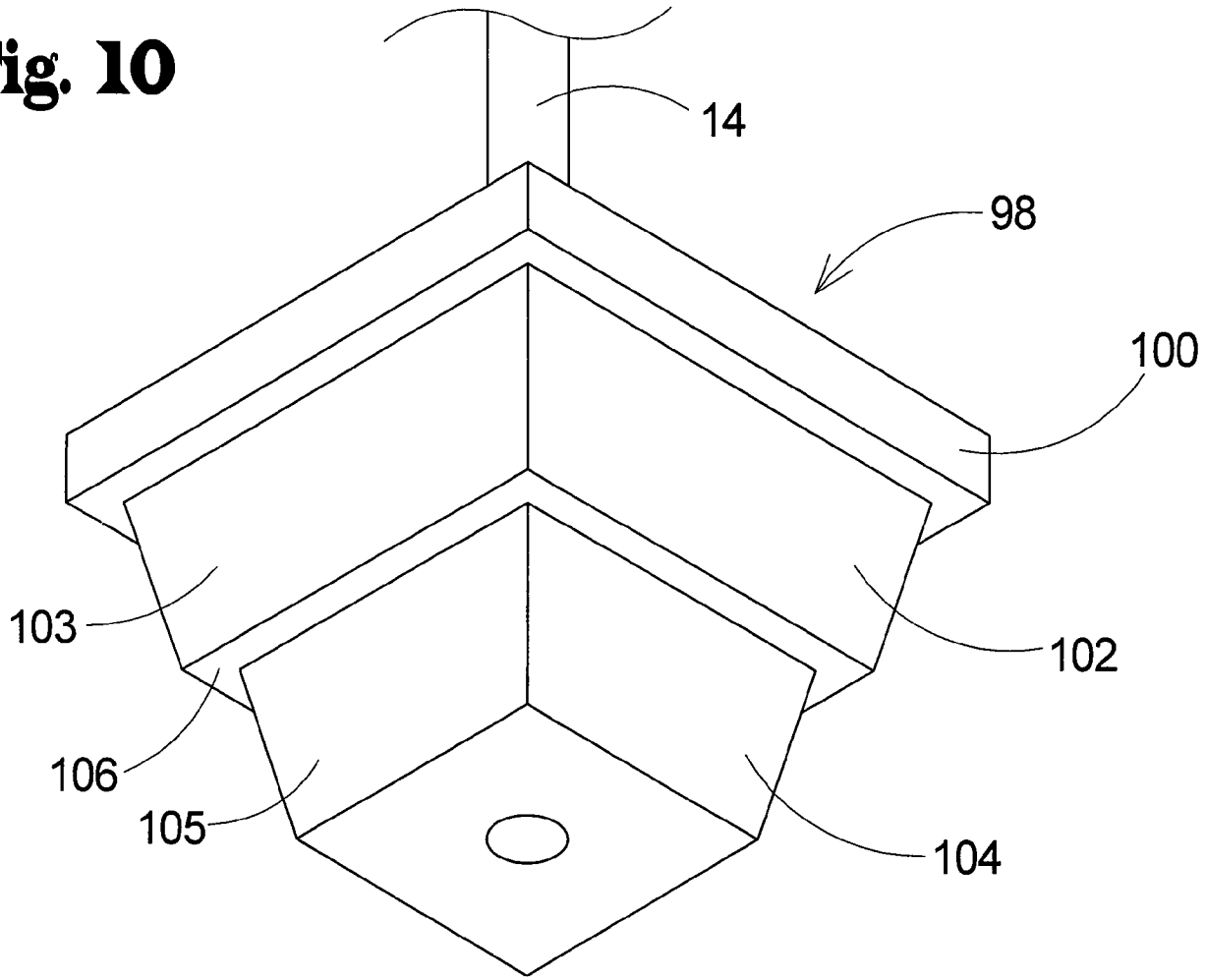
FIG. 10 is a perspective view of the present invention showing an optional insert base assembly.

As a further option, as shown in FIG. 10, the base assembly 12 may comprise an insert member 98 that is mounted on a lower end of the stanchion member 14. The insert member 98 may have a base section 100 and at least one additional section. The base section 100 is positioned adjacent to the stanchion member 14, with a first one 102 of the additional sections being positioned adjacent to the base section. The first additional section 102 may have a perimeter surface 103, and the perimeter surface may be substantially frusta-pyramidal in shape. A second one 104 of the additional sections, if included, may be positioned adjacent to the first additional section 102 at a location opposite of the base section 100. The second additional section 104 may also have a perimeter surface 105 that is substantially frusta-pyramidal in shape. The width of the first additional section 102 may be greater than the width of the second additional section 104, and a shoulder surface 106 may be formed on the first additional section between the perimeter surface 103 of the first additional section and the perimeter surface 105 of the second additional section. The insert member 98 may be formed of an elastomeric material, such as rubber or synthetic rubber, and may be highly useful for inserting into the pocket formed in the bed of a pickup truck, such as is commonly found on the side wall of the pickup bed.

Figure 11:
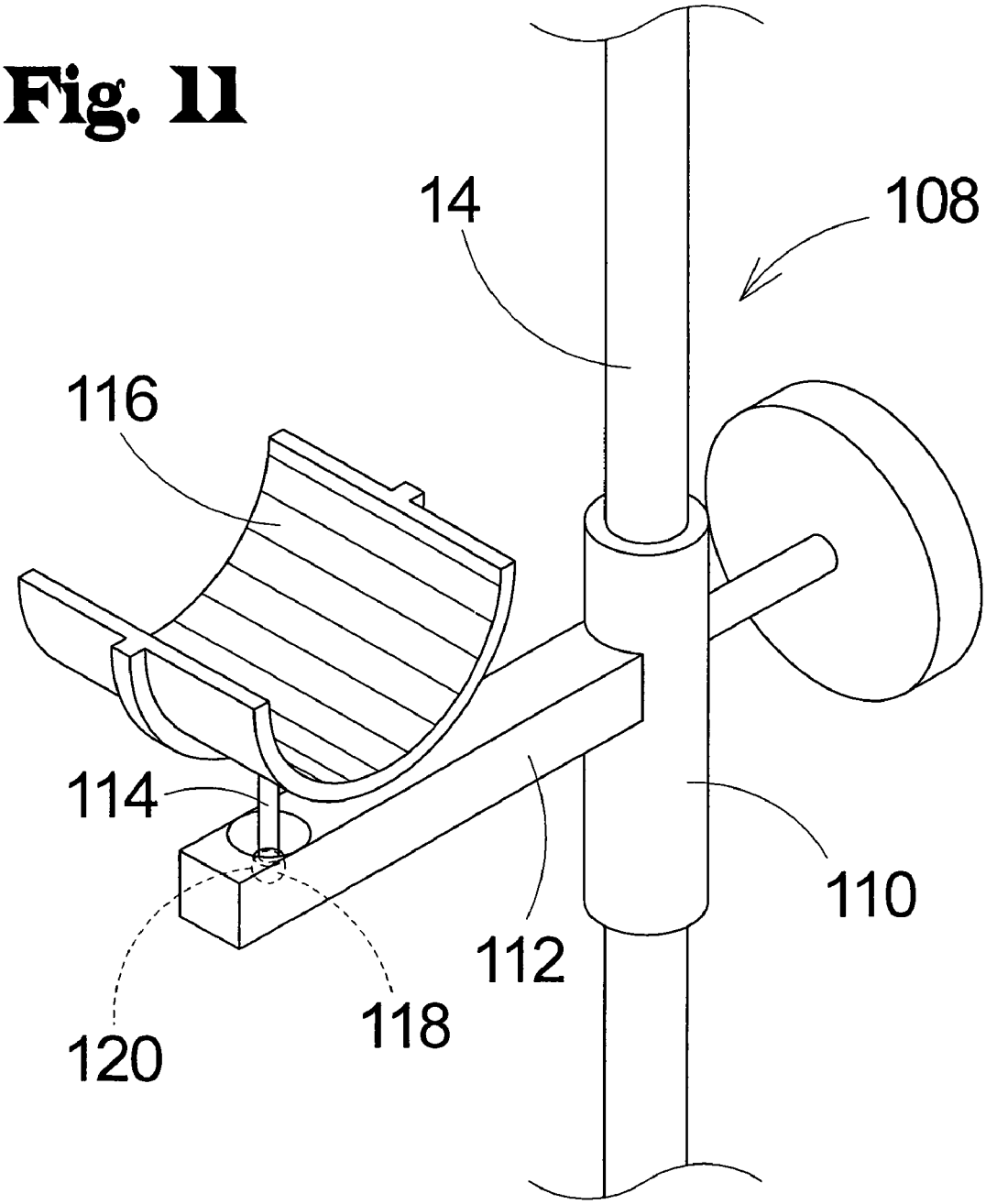
FIG. 11 is a perspective view of the present invention showing an optional swivel cradle of the support assembly.
Figure 12:
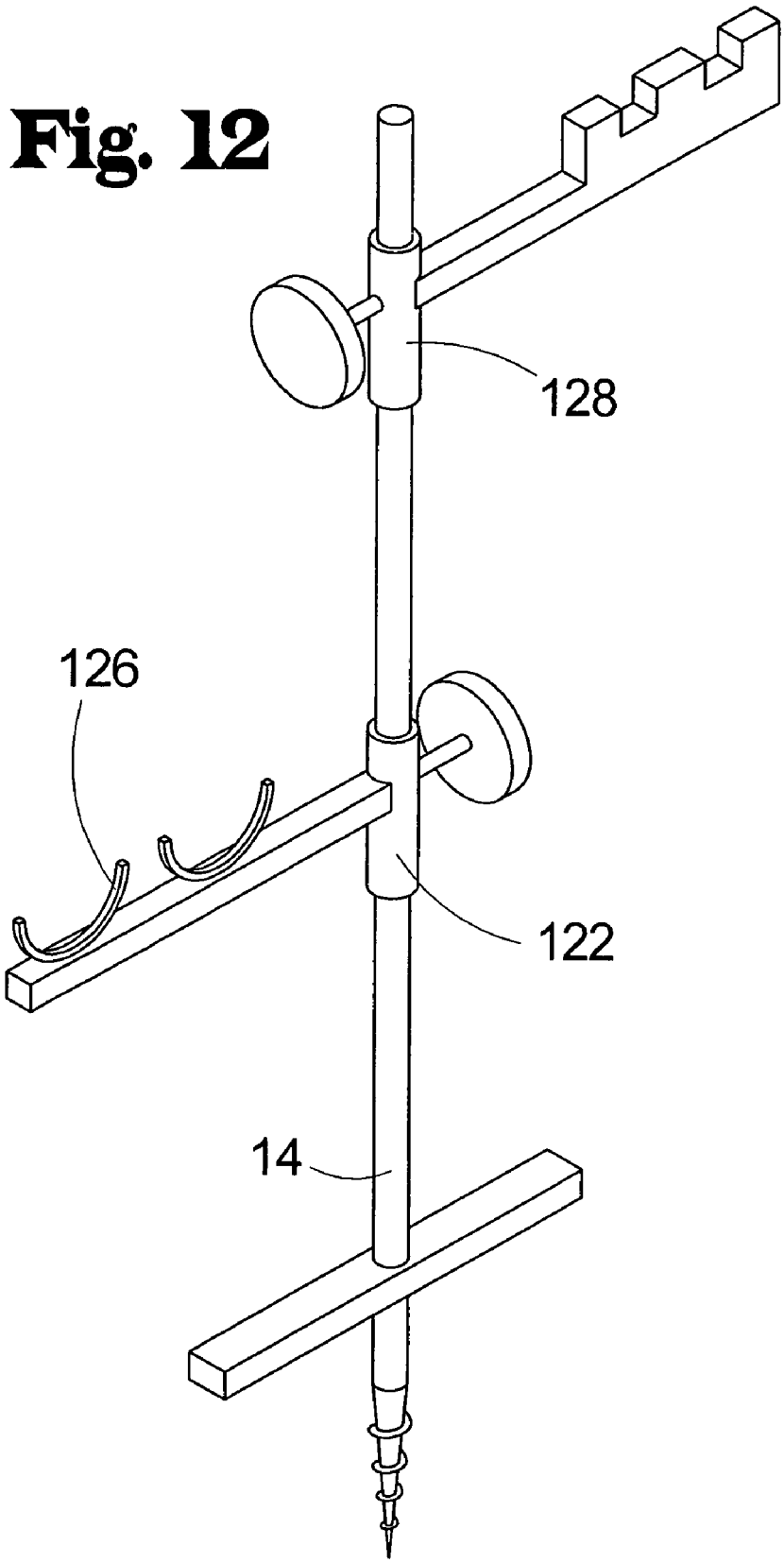
FIG. 12 is a perspective view of the present invention showing optional cradle configurations of the support assembly.

In an optional configuration of the support assembly, shown in FIG. 11, a cradle assembly 108 comprises a sleeve member 110 that slidably receives the stanchion member 14, an extension member 112 that extends from the sleeve member, a standoff member 114 that is mounted on the extension member, and a cradle member 116 mounted on the standoff member at a location spaced from the extension member. Significantly, the mounting of the standoff member 114 to the extension member 112 comprises a ball and socket structure that permits swiveling of the standoff member and the cradle member 116 with respect to the extension member and the stanchion member 14. The ball and socket structure may comprise a ball 118 mounted on the standoff member 114 and positioned in a socket 120 on the extension member 112 at a located spaced from the sleeve member 110.

In another optional configuration of the support assembly, shown in FIG. 11, a sleeve member 122 slidably receives the stanchion member 14, an extension member 124 extends from the sleeve member, and at least one substantially semi-circular support 126 is mounted on the extension member 124. In some embodiments, a pair of the semi-circular supports 126 is employed. Illustratively, the substantially semi-circular support 126 may comprise a wire with a semi-circular shape. This configuration may be highly suitable for adapting the device 10 of the invention for other support uses, such as in the support of a fishing rod.

Also shown in FIG. 11 is a support assembly that comprises a sleeve member 128 that slidably receives the stanchion member 14, an extension member 130 that extends from the sleeve member 128, and a bar 132 that is mounted on the extension member 130. At least one notch 134 may be formed in the bar 132, and optionally a pair of notches may be formed in the bar along a same edge of the bar. The edge 136 in which the notch or notches are positioned may extend along an axis extending radially outwardly from the sleeve member 128.

In use, the user places the base assembly 12 on the support surface couples the stanchion member 14 to the receiver member 18 of the base assembly 12. The sleeve member 30 of the cradle assembly 28 is slid onto the stanchion member 14 and adjusted to the desired height with the locking member 32 securing the cradle assembly 28 in the desired position. The firearm is then positioned in the cradle member 34 and the retaining member 36 is extended across the firearm and the locking nub 42 is secured under the tabs 44 coupled to the cradle member 34. The firearm is then stabilized during the aiming process and the discharge process of the firearm to provide a more accurate use of the firearm.

It will be recognized by those skilled in the art that the inventive structures described above may be formed of any suitable strong and rigid material, such as, for example, metals including steel and aluminum, but may also be formed of suitably strong and rigid plastic materials, as well as materials that will be developed in the future that have the requisite strength and rigidity. Lightweight materials may be favored over materials that are heavier, to facilitate transport of the apparatus.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gun shooting rest device for supporting a firearm during discharge of the firearm, the gun shooting rest device comprising:

a base assembly for selectively engaging a support;

a stanchion member extends away from said base assembly; and a support assembly being coupled to said stanchion member such that said support assembly is positioned a distance from said base assembly, said support assembly being for selectively supporting the firearm to facilitate sighting of the firearm and steadying the firearm during discharge of the firearm;

wherein the support assembly includes a cradle assembly, the cradle assembly comprising:

a sleeve member slidably receiving the stanchion member;

an extension member extending from the sleeve member;

a standoff member being mounted on the extension member; and a cradle member mounted on the standoff member at a location spaced from the extension member;

wherein a mounting of the standoff member to the extension member comprises a ball and socket structure that permits swiveling of the standoff member and the cradle member with respect to the extension member and the stanchion member; and wherein an axis of the extension member is oriented substantially perpendicular to an axis of the stanchion member.

2. The gun shooting rest device as set forth in claim 1, wherein said base assembly comprises a receiver member for selectively receiving said stanchion member, said stanchion member being selectively removable from said receiver member to permit more compact storage of said base assembly and said stanchion member when not in use.

3. The gun shooting rest device as set forth in claim 2, wherein said base assembly comprise a securing member being operationally coupled to said receiver member, said securing member selectively extending through said receiver member such that said securing member selectively engages said stanchion member to inhibit inadvertent removal of said stanchion member from said receiver member.

4. The gun shooting rest device as set forth in claim 2, wherein said base assembly comprises a pluralilty of leg members coupled to said receiver member, each of said leg members extend outwardly from said receiver member, said leg members being for engaging the support to inhibit sliding of said base assembly along the support when the firearm is being steadied and discharged.

5. The gun shooting rest device as set forth in claim 4, wherein each of said leg members comprises a base portion and an end portion, said base portion being coupled to said receiver member such that said end portion is positioned opposite said receiver member, said end portion of each of said leg members being for engaging the support to inhibit sliding of said base assembly with respect to the support.

6. The gun shooting rest device as set forth in claim 5, wherein said end portion of each of said leg members is coated in a friction enhancing material, said friction enhancing material being for increasing friction between said end portion of said leg members and the support to inhibit sliding of the base assembly across the support when the support is a hard surface.

7. The gun shooting rest device as set forth in claim 5, wherein said end portion of each of said leg members extends at an angle to said base portion of the associated one of said leg members to facilitate said end portion of each of said leg portions insertion into the support when the support is a soft surface.

8. The gun shooting rest device as set forth in claim 7, wherein said end portion of each of said leg members tapers to a point opposite said base portion of the associate one of said leg members to facilitate insertion of said end portion of each of said leg members into the support when the support comprises soil.

9. The gun shooting rest device as set forth in claim 4, wherein said base assembly comprises a foot assembly, said foot assembly being pivotally coupled to one of said foot members such that said foot assembly is selectively pivoted to engage a surface of the support when the surface of the support is uneven.

10. The gun shooting rest device as set forth in claim 2, wherein said base assembly comprises a clip portion, said clip portion being coupled to said receiver member, said clip member being for engaging a belt of a user to permit said stanchion member and said support assembly to be supported from the belt of the user when the user is discharging the firearm while walking.

11. The gun shooting rest device as set forth in claim 1, wherein said base assembly comprises an auger arm for being threadably inserted into the support to support said stanchion member and said support assembly from the support, said auger arm being coupled to said receiver member.

12. The gun shooting rest device as set forth in claim 11, wherein said base assembly comprises a plurality of handle members being coupled to said auger arm to facilitate gripping of said auger arm when said auger arm is threadably inserted into the support, said handle members extending outwardly from said auger members such that said handle members are for being grasped by a user to facilitate gripping of said auger arm.

13. The gun shooting rest device as set forth in claim 1, wherein said support assembly comprises at least one cradle assembly being selectively coupled to said stanchion member, said cradle assembly selectively receiving a portion of the firearm such that said cradle assembly supports the firearm.

14. The gun shooting rest device as set forth in claim 13, wherein said cradle assembly comprises a sleeve member slidably receiving said stanchion member, said sleeve member permitting said cradle assembly to be positioned along a portion of a length of said stanchion member to adjust a distance between said cradle assembly and said base assembly.

15. The gun shooting rest device as set forth in claim 14, wherein said cradle assembly comprises a cradle member being coupled to said sleeve member, said cradle member being for selectively receiving a portion of the firearm to support the firearm when the firearm is being sighted and discharged.

16. The gun shooting rest device as set forth in claim 15, wherein said cradle assembly comprises a retaining member for inhibiting inadvertent exiting of the fire arm from said cradle member when the firearm is discharged, said retaining member comprising a first end coupled to said cradle member, said retaining member being selectively extended across said cradle member such that a second end of said retaining member is selectively coupled to said cradle member opposite said first end to secure said retaining member across said cradle member.

17. The gun shooting rest device as set forth in claim 16, wherein said support assembly comprises a bar assembly being selectively coupled to said stanchion member such that said bar assembly is selectively positioned along a length of said stanchion member, said bar assembly being for selectively receiving a plurality of cradle assemblies such that said cradle assemblies are aligned to allow each of said cradle assemblies to support a portion of the firearm.

18. The gun shooting rest device as set forth in claim 1, wherein the base assembly comprises a multi-legged assembly, the multi-legged assembly comprising a plurality of leg members radially extendable from the stanchion member, each leg member of the plurality of leg members being pivotable with respect to the stanchion member.

19. The gun shooting rest device as set forth in claim 1, wherein the base assembly comprises an insert member mounted on a lower end of the stanchion member, the insert member having a first section and at least one additional section, a first one of the additional sections being positioned adjacent to the base section, the first additional section having a perimeter surface, the perimeter surface being substantially frusta-pyramidal in shape.

20. A gun shooting rest device for supporting a firearm during discharge of the firearm, the gun shooting rest device comprising:

a base assembly for resting on a support surface;

an elongated stanchion member mounted on and extending upwardly away from the base assembly, the stanchion member having a substantially vertically oriented axis when the base assembly is rested on a substantially horizontal support surface; and a support assembly being coupled to said stanchion member for selectively supporting the firearm to facilitate sighting of the firearm and steadying the firearm during discharge of the firearm, the support assembly comprising:

a sleeve member slidably receiving the stanchion member to permit positioning of the sleeve member at least two different locations along the axis of the stanchion member above the support surface;

an elongated extension member mounted on and extending away from the sleeve member such that the extension member extends in a generally horizontal direction from the stanchion member when the axis of the stanchion member is substantially vertically oriented;

a standoff member being mounted on the extension member in a horizontally offset position from the axis of the stanchion member; and a cradle member configured to receive a portion of a firearm, the cradle member being mounted on the standoff member at a location spaced from the extension member;

wherein the cradle member is configured to swivel with respect to the extension member to permit adjustment of the positioning of a firearm on the cradle member.

21. The gun shooting rest device as set forth in claim 20, wherein a mounting of the standoff member to the extension member comprises a ball and socket structure that permits swiveling of the standoff member and the cradle member with respect to the extension member and the stanchion member.

* * * * *